United States Patent [19]

Dixon

[11] Patent Number: 4,775,054

[45] Date of Patent: Oct. 4, 1988

[54] PRODUCT DISPLAY SYSTEM

[75] Inventor: Herbert O. Dixon, West Des Moines, Iowa

[73] Assignee: DFM Corporation, West Dest Moines, Iowa

[21] Appl. No.: 37,882

[22] Filed: Apr. 13, 1987

[51] Int. Cl.[4] ..... A47F 7/00

[52] U.S. Cl. ..... 211/57.1; 211/60.1; 211/59.1

[58] Field of Search ..... 211/57.1, 59.1, , 54.1, 211/60.1, 189, 87, 106, 181, 88

[56] References Cited

U.S. PATENT DOCUMENTS

| | | | |
|---|---|---|---|
| 94,127 | 8/1869 | Oatley | 211/106 X |
| 272,000 | 2/1883 | Umbdenstock | 211/106 |
| 485,514 | 11/1892 | Thompson | 211/57.1 |
| 2,246,081 | 6/1941 | Van Nattan | 211/60.1 |
| 3,385,451 | 5/1968 | Anderson | 211/60.1 |
| 3,726,415 | 4/1973 | Malik | 211/59.1 X |
| 4,344,540 | 8/1982 | Marschak | 211/59.1 X |

*Primary Examiner*—J. Franklin Foss
*Assistant Examiner*—Sarah A. Lechok Eley
*Attorney, Agent, or Firm*—Cullen, Sloman, Cantor, Grauer, Scott & Rutherford

[57] ABSTRACT

The present invention provides for single, double or multiple row display systems for easily and clearly displaying products, such as bug shields. The display system includes a rigid frame extending from the wall at a distance above the floor, and a rigid retainer assembly extending from the wall between the frame and the floor. The frame and retainer assemblies define upper and lower compartments for receiving and holding the product, which rests upon the floor. Optional peghook assemblies can be attached to the frame for displaying different, smaller-sized products, such as bug shield trim kits. The display system can be assembled quickly and easily without the use of tools.

15 Claims, 3 Drawing Sheets

PRODUCT DISPLAY SYSTEM

BACKGROUND OF THE INVENTION

The present invention is directed towards a product display system. More particularly, the invention is directed towards a system for displaying elongated products such as bug shields which may be packaged in a relatively long and narrow box. These products are difficult to display because of their size and shape. Also, the packaging boxes, which have a primary surface wherein the label of the product is placed, are not easily displayed without covering the label, due to the dimensions of the box.

Accordingly, a primary objective of the present invention is the provision of a product display system for bug shields and the like.

Another objective of the present invention is the provision of a product display system which allows the product to be easily and clearly displayed.

A further objective of the present invention is the provision of a product display system which can be quickly and easily assembled and which can be quickly and easily installed on a store fixture.

Still another objective of the present invention is the provision of a product display system which is economical to manfacture and durable in use.

These and other objectives will become apparent from the following description of the invention.

SUMMARY OF THE INVENTION

The product display system of the present invention is designed for quick and easy attachment to a store fixture or wall extending upwardly from the floor. The system includes a rigid frame extending substantially horizontally from the wall at a distance spaced above the floor. A rigid retainer assembly attached directly or indirectly to the frame also extends from the wall between the frame and the floor. The frame and retainer assembly are made of wire or the like and each has opposite sides with an interconnecting web so as to define upper and lower product compartments, respectively. The bug shield or other product to be displayed rests upon the floor and is positioned within the compartments which prevent the product from falling. The upper and lower compartments may be further subdivided by crossbars. Also, peg hooks may be attached to the frame for displaying different products, such as bug shield trim kits and hardware kits.

The frame is attached to the wall by integral or independent hooks which are received in a hole in the wall. The frame is maintained in a substantially horizontal position by a support assembly at each side of the frame. Alternatively, the frame may include an integral support leg which engages the wall to hold the frame in a horizontal position. The retainer assembly is connected to the support assembly or directly to the frame. For quick and easy assembly of the display system, clip means are provided on one component, such as the frame, and the other component, such as the support assembly or retainer assembly, has a leg which is received into the corresponding clip means so as to attach one component to the other. Thus, no tools are required for assembling the display system.

DETAILED DESCRIPTION OF THE DRAWINGS

Figure 1:
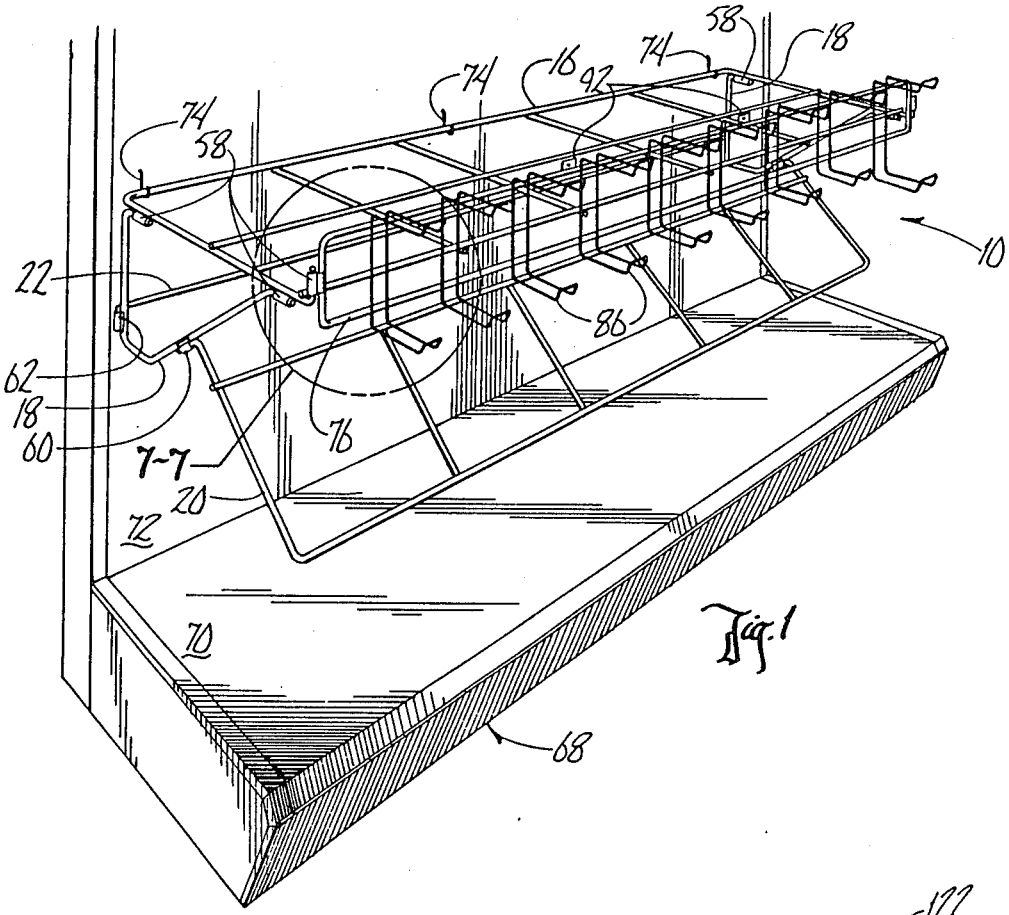
FIG. 1 is a perspective view of a multiple row display system according to the present invention.
Figure 2:
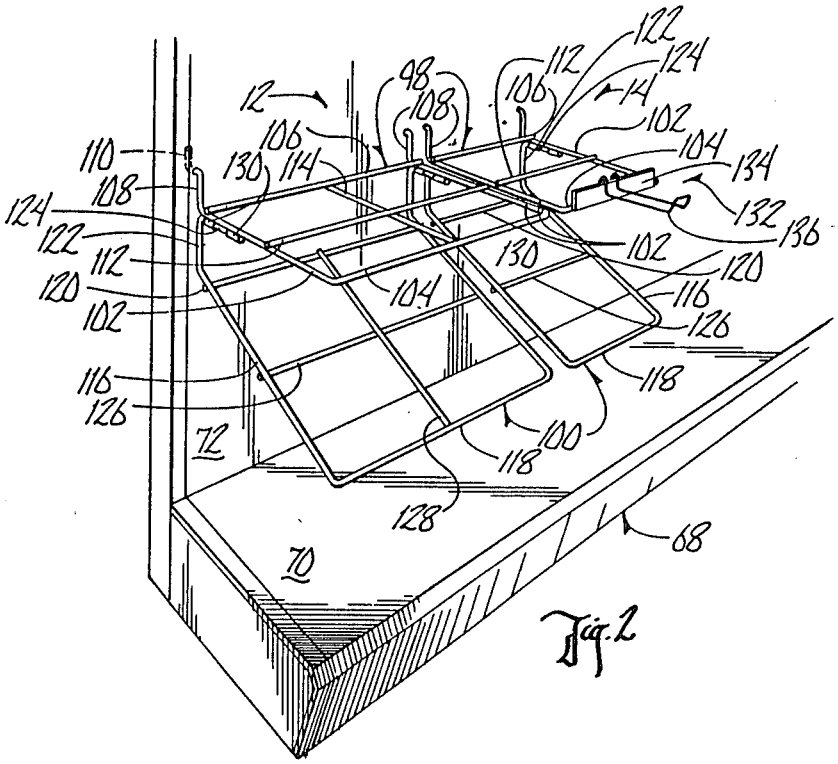
FIG. 2 is a perspective view of alternative double and single row display systems.

Three embodiments of the product display system of the present invention are shown in FIGS. 1 and 2 of the drawings. A multiple row display system 10 is shown in FIG. 1, while a double row display system 12 and a single row display system 14 are shown in FIG. 2. These display systems are useful for displaying and holding elongated products, such as bug shields. The product may be boxed or unboxed.

The multiple row display system 10 includes a frame 16, a support assembly 18, a retainer assembly 20, and stabilizer bar 22. Frame 16 includes opposite sides 24, a front interconnecting web 26, and a back interconnecting web 28. Sides 24, and webs 26,28 form an enclosed compartment, which is further subdivided by crossbars 30 and 32. Frame 16 also has a leg 34 extending upwardly adjacent front web 26 at each side of the frame.

Support assembly 18 includes a back upright 36, and a front upright 38 which are connected at their lower ends. Legs 40, 42 project forwardly from back upright 36 and front upright 38, respectively.

Retainer assembly 20 includes opposite sides 44 and an interconnecting web 46. Retainer assembly 20 also includes crossbars 48, 50. A leg 52 extends from each side 44 of retainer assembly 20.

Stabilizer bar 22 includes opposite legs 54 and an interconnecting web 56.

Figure 7:
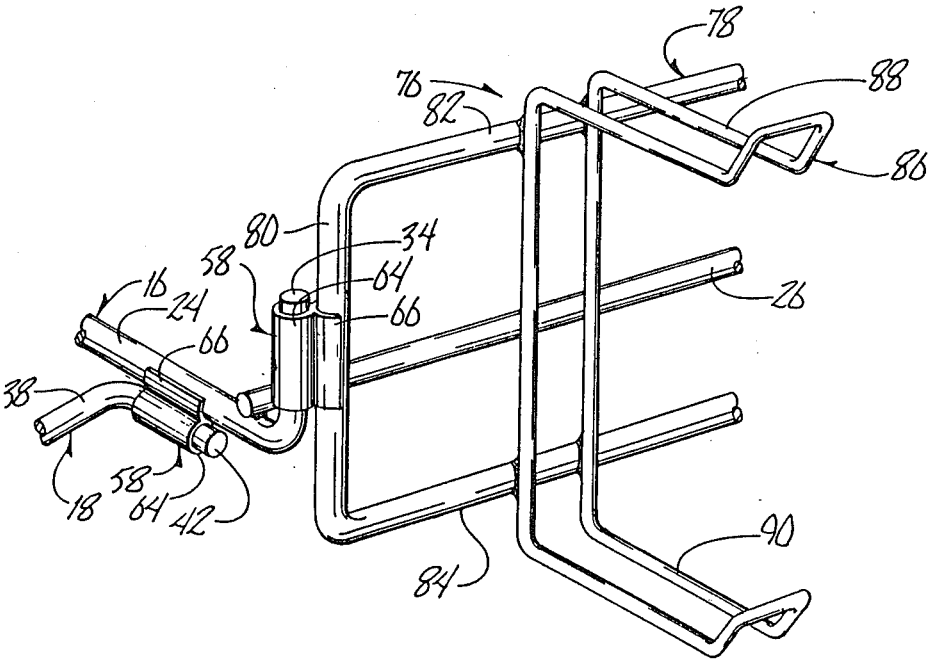
FIG. 7 is an enlarged perspective view taken along line 7—7 FIG. 1.

For assembling the multiple row display system 10, a plurality of clip means are provided. In particular, a pair of clip means 58 are provided on each side 24 of frame 16 and are adapted to slidably receive legs 40, 42 of support assembly 18. Similarly, a clip means 60 is provided on front upright 38 of support assembly 18 for receiving leg 52 of retainer assembly 20. A clip means 62 is provided on back upright 36 of support assembly 18 for receiving leg 54 of stabilizer bar 22. Thus, the legs of each component slip-fits into the corresponding clip means of the associated component, such that no tools are required for assembling the display system. The clip means are all identical and are best seen in FIG. 7. Preferably, each clip means includes a tubular portion 64, and a semi-circular portion 66 which is attached to side 24 of frame 16 by welding, adhesives, or press fit. It is understood that the clip means may take other forms without departing from the scope of the present invention.

The multiple row display system 10 is secured to a store fixture 68, which has a floor 70 and an upright wall 72, by a plurality of hooks 74 which have an upper hook portion received in a hole in the wall and a lower hook portion for supporting back web 28 of frame 16. A portion of support assmbly 18 engages wall 72 such that front upright 38 holds frame 16 in a substantially horizontal position. Retainer assembly 20 extends forwardly from front upright 38.

Figures 3, 4, 5:
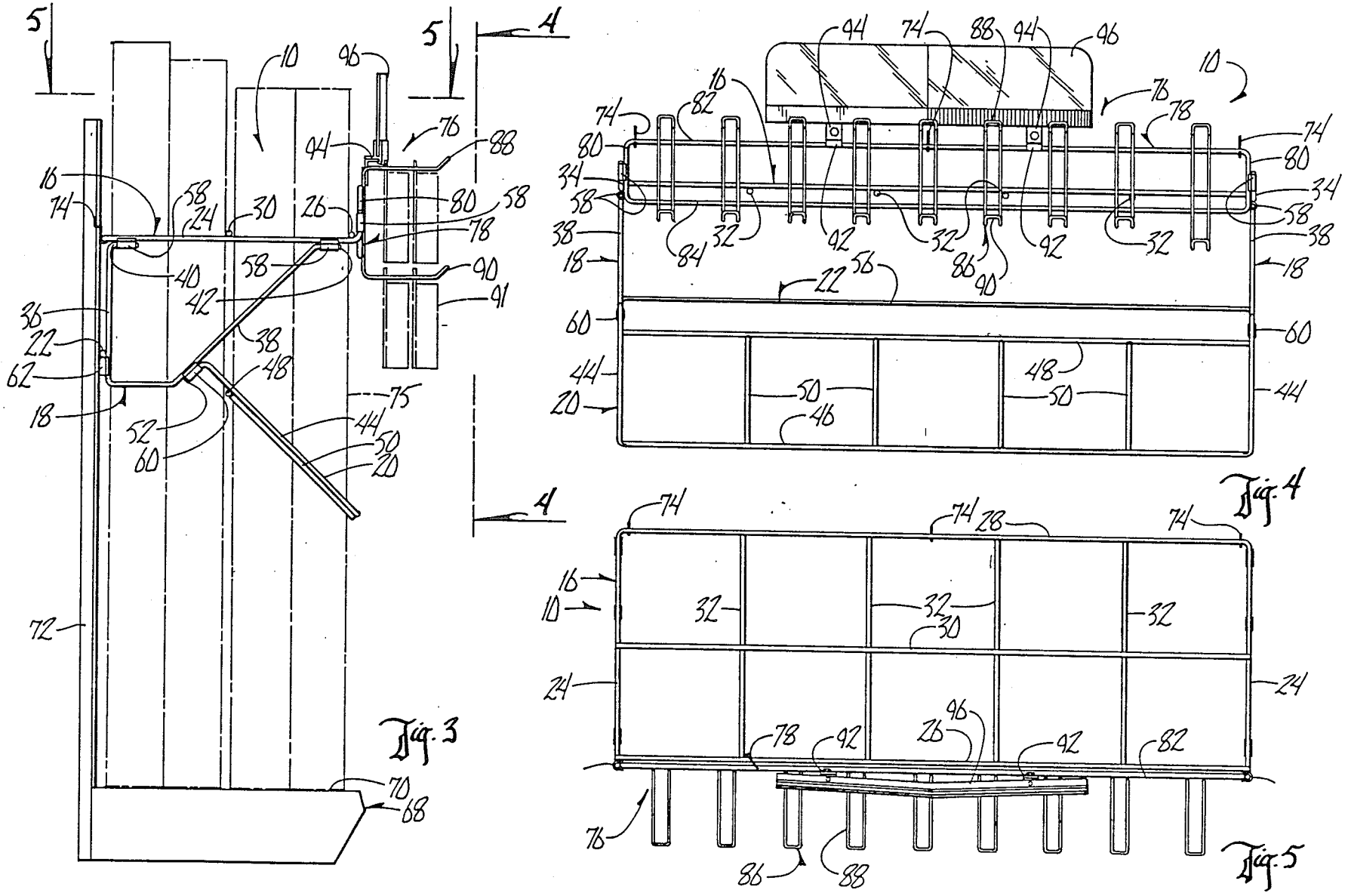
FIG. 3 is a side view of the display system shown in FIG. 1.
FIG. 4 is a front view of the display system shown in FIG. 1, taken along lines 4—4 of FIG. 3.
FIG. 5 is a top view of the display system shown in FIG. 1, taken along lines 5—5 of FIG. 3.
Figure 6:
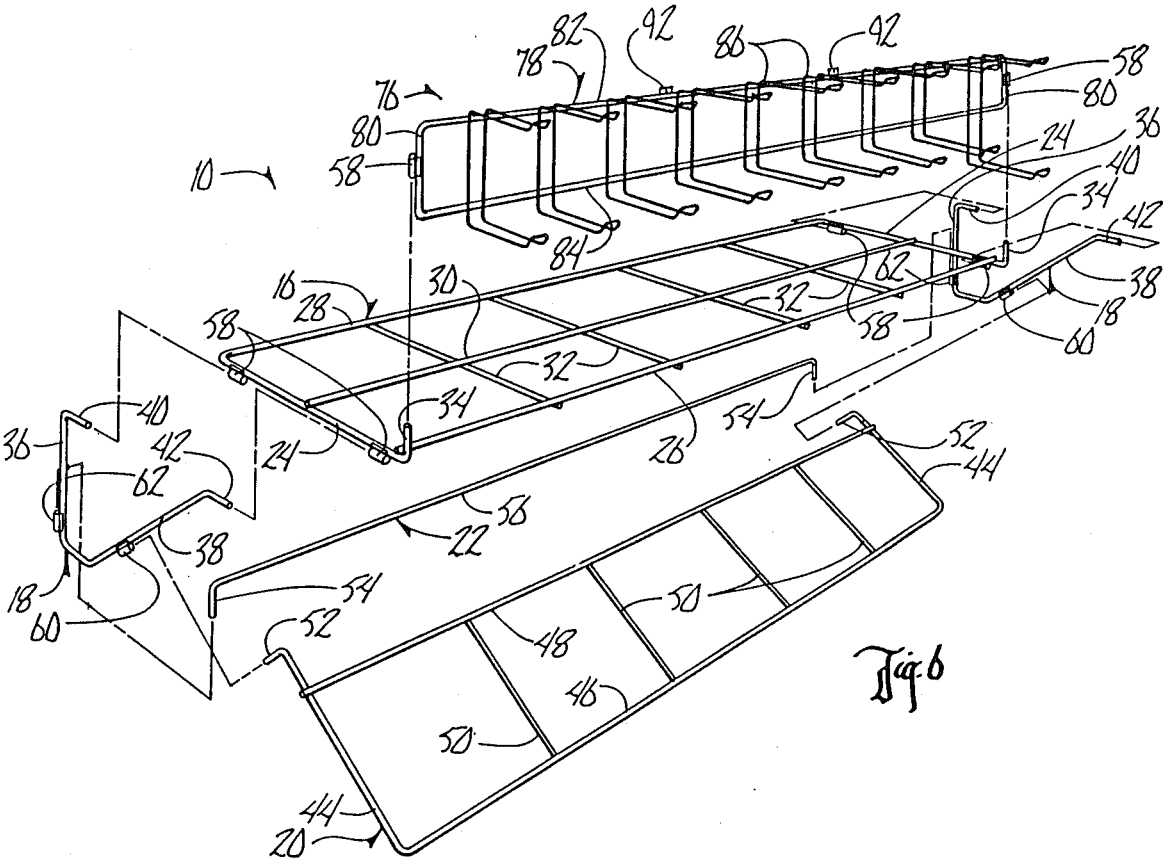
FIG. 6 is an exploded perspective view showing the components of the multiple row display system.

Frame 16 and retainer assembly 20 define upper and lower compartments, respectively, which are subdivided by the crossbars such that the assembled display system forms multiple rows for displaying the bug shield or similar product. As seen in FIG. 3, the product 75 rests upon floor 70 and is held in a substantially upright position by frame 16 and retainer assembly 20. Since the display system is formed from wire, plastic or the like, the product remains clearly visible, while being displayed in an orderly fashion.

A peghook assembly 76 is optionally provided for display system 10. More particularly, peghook assembly 76 includes a rectangular frame 78 having opposite sides 80 and upper and lower interconnecting webs 82 and 84, respectively. A plurality of C-shaped hook means 86 are attached to the upper and lower webs of frame 78 by welding or the like, and extend substantially along the length thereof in spaced relation to one another. Each hook means 86 includes an upper hook 88 and a lower hook 90 which are adapted to display a different, small-sized product, such as a bug shield trim kit or hardware kit 91, or other product which typically is attached to a cardboard backing which has a hole therein for receiving the upper or lower hook. The size of the hook means 86 can vary, depending on the product to be displayed thereby. For example, as best seen in FIG. 4, the hook means 86A is shown to be larger than the remaining hook means. Each side 80 of frame 78 includes a clip means 58, as described previously, which fits over leg 34 of frame 16 so as to attach peghook assembly 76 to display system 10.

Peghook assembly 76 also has a pair of spaced apart tabs 92 extending upwardly from upper web 82. Tabs 92 are adapted to display the actual product out of its box or container. For example, as shown in FIGS. 3 and 4, mounting brackets 94 of a bug shield 96 are secured to tabs 92 by a bolt or the like.

The double row display system 12 and single row display system 14 are functionally identical to the multiple row display system 10, but are shown to have an alternate construction. The double and single row display systems are substantially structurally identical to one another, and therefore the same numerals will be used to designate similar elements of each display system.

Display systems 12 and 14 include a frame 98 and a retainer assembly 100. Frame 98 includes opposite sides 102, a front interconnecting web 104, and a back interconnecting web 106. Frame 98 also has a back leg 108 extending upwardly from each side 102 and terminating in a hook portion 110 which is received in a hole in wall 72. Legs 108 engage the wall so as to support frame 98 in a substantially horizontal position. Frame 98 forms an upper compartment for enclosing the product which can be subdivided by crossbars 112, 114.

Retainer assembly 100 includes opposite sides 116, a front interconnecting web 118 and a back interconnecting web 120. Retainer assembly 100 also includes a back upright portion extending upwardly at the rearward end of each side, with each upright portion terminating in a forwardly projecting leg 124. The retainer assembly forms a lower compartment for surrounding the product which can be subdivided into smaller compartments by crossbars 126 and 128.

Frame 98 includes a pair of clip means 130, similar to those described previously, secured to each side 102. Legs 124 slip fit into the corresponding clip means 130 so that retainer assembly 100 is connected to frame 98 and supported thereby. At least a portion of upright portion 122 of retainer assembly 100 engages wall 72 so that sides 116 will extend forwardly from the wall.

An optional peghook assembly 132 can also be provided on display systems 12 and 14. Peghook assembly 132 includes a spacer bar 134 which is attached to front web 104 of frame 98 by any convenient manner, and at least one hook means 136 which is supported by the spacer bar and extends outwardly therefrom. Peghook assembly 132 is adapted to receive and display different products, such as those described with respect to peghook assembly 76.

Display systems 10, 12 and 14 are preferably made of a rigid wire, plastic or the like. It is understood that the precise configuration of the display system components can be altered, without departing from the scope of the present invention. Also, the structures shown in FIGS. 1 and 2 can be manufactured with any desired number of display rows.

From the foregoing, it can be seen that the present invention accomplishes at least all of the stated objectives.

What is claimed is:

1. A product display system for use on a wall extending upwardly from a floor, comprising:

a rigid frame hanging from the wall at a distance above the floor;

a rigid retainer assembly operatively hanging from the wall at a distance above the floor and below the frame;

the frame having opposite sides and an interconnecting web so as to define an upper product compartment spaced above the floor;

the retainer assembly having opposite sides and an interconnecting web so as to define a lower product compartment spaced above the floor; and the display product being positioned within the upper and lower compartments and being supported by the floor.

2. The display system of claim 1 wherein the frame and retainer assembly each have at least one dividing bar to subdivide the respective upper and lower compartments into smaller subcompartments.

3. The display system of claim 1 wherein a support assembly is operatively attached to each side of the frame and has a portion engaging the wall so as to hold the frame in a substantially horizontal position.

4. The display system of claim 3 wherein the frame has a clip means on each side thereof and each support assembly has a leg which slip-fits into the corresponding clip means so as to attach the support assembly to the frame.

5. The display system of claim 3 wherein the retainer assembly is operatively attached to the support assembly.

6. The display system of claim 5 wherein each support assembly has clip means thereon and the retainer assembly has a leg on each side thereof which slip-fits into the corresponding clip means of the support assembly so as to attach the retainer assembly to the support assembly.

7. The display system of claim 1 further comprising at least one peghook assembly operatively attached to the frame for displaying a different product from the peghook assembly.

8. The display system of claim 7 wherein the peghook assembly includes a mounting frame having opposite ends, clip means attached to each end of the mounting frame, and at least one hook extending from the mounting frame for hanging the different products on, and the frame having an upturned leg at each side which slip-fits into the corresponding clip means on the mounting frame of the peghook assembly so as to attach the peghook assembly to the frame.

9. The display system of claim 7 wherein the peghook assembly includes a spacer bar attached to the frame and a hook means secured to the spacer bar.

10. The display system of claim 1 wherein the retainer assembly includes a support portion at each end thereof which engages the wall to hold the retainer assembly in a position extending from the wall.

11. The display system of claim 10 wherein the frame has clip means on each side and the retainer includes a leg at each end which slip-fits into the respective dip means of the frame to attach the retainer assembly to the frame.

12. The display system of claim 1 further comprising hook means operatively attached to the frame and being received in holes in the wall so as to secure the frame to the wall.

13. The display system of claim 1 wherein the frame has an upwardly extending back leg at each end with a hook on the end of each leg, the hooks being received in holes in the wall and the back legs engaging the wall so as to secure the frame to the wall and support the frame in a substantially horizontal position.

14. The display system of claim 1 further comprising a tab secured to said frame to which an additional product can be mounted for display.

15. The display system of claim 7 wherein said peg hook assembly includes a plurality of C-shaped hook members operatively attached to said frame so as to provide upper and lower rows of hooks for displaying the different product.

* * * * *

UNITED STATES PATENT AND TRADEMARK OFFICE

CERTIFICATE OF CORRECTION

PATENT NO. : 4,775,054

DATED : October 4, 1988

INVENTOR(S) : Herbert O. Dixon

It is certified that error appears in the above-identified patent and that said Letters Patent is hereby corrected as shown below:

In column 6, line 1, "dip" should be --clip--.

Signed and Sealed this

Fourteenth Day of February, 1989

*Attest:*

DONALD J. QUIGG

*Attesting Officer*

*Commissioner of Patents and Trademarks*